United States Patent [19]

Katzer et al.

[11] 4,162,045

[45] Jul. 24, 1979

[54] ORE GRINDING PROCESS

[75] Inventors: Melvin F. Katzer, Danville, Calif.; Richard R. Klimpel, Midland, Mich.; Willy Manfroy, Carmel, Ind.

[73] Assignee: The Dow Chemical Company, Midland, Mich.

[21] Appl. No.: 932,884

[22] Filed: Aug. 11, 1978

Related U.S. Application Data

[63] Continuation-in-part of Ser. No. 853,735, Nov. 21, 1977, abandoned, which is a continuation-in-part of Ser. No. 687,795, May 19, 1976, abandoned.

[51] Int. Cl.[2] ..... B02C 23/18

[52] U.S. Cl. ..... 241/16; 51/298; 51/316

[58] Field of Search ..... 241/15, 16, 18, 20, 241/30; 51/308, 298, 316

[56] References Cited

U.S. PATENT DOCUMENTS

| | | | |
|---|---|---|---|
| 2,709,661 | 5/1955 | Dietz | 241/16 |
| 2,905,565 | 9/1959 | Dietz et al. | 241/16 |
| 3,104,068 | 9/1963 | Castelli | 241/16 |
| 3,252,662 | 5/1966 | Lyons | 241/16 |
| 3,534,911 | 10/1970 | Gwilliam | 241/16 |
| 3,604,634 | 9/1971 | Windle | 241/16 |
| 3,756,979 | 9/1973 | Ventres | 241/16 |
| 3,950,182 | 4/1976 | Steel | 241/15 |
| 3,989,195 | 11/1976 | Steward | 241/16 |

FOREIGN PATENT DOCUMENTS

| | | | |
|---|---|---|---|
| 47200 | 10/1971 | Australia | 241/16 |

OTHER PUBLICATIONS

Chem. Abstracts, vol. 55, 16309d, 1961.

Chem. Abstracts, vol. 59, 1297a, 1963.

"Chem. Enhancement of Ore Grinding Efficiency," Hartley et al., Battelle, Pacific NW Laboratories, Aug. 5–7, 1976.

"Crushing and Grinding," G. C. Lowrison, pp. 106–110, 1974, CRC Press Inc., Cleveland, Ohio.

"Computers and Operations Research in Mineral Industries," R. Klimpel and W. Manfroy, Oct. 4–8, 1976, 14th Internat. Symposium.

*Primary Examiner*—Donald J. Arnold

*Attorney, Agent, or Firm*—G. D. Street

[57] ABSTRACT

A process for grinding coal or ores containing metal values comprising carrying out said grinding in a liquid medium and with a grinding aid system comprising an anionic polyelectrolyte derived from polyacrylic acid and certain inorganic metal salts, said system being dispersible in the liquid medium and being present in an amount effective to provide increased grinding efficiency.

22 Claims, No Drawings

ORE GRINDING PROCESS

CROSS-REFERENCE TO RELATED APPLICATIONS

This application is a continuation-in-part of our copending application Ser. No. 853,735, filed Nov. 21, 1977 now abandoned, which in turn is a continuation-in-part of our application Ser. No. 687,795, filed May 19, 1976, now abandoned.

BACKGROUND OF THE INVENTION

The present invention relates to the use of polyacrylic acid-derived polymers and inorganic metal salts as a grinding aid system to increase the rate of coal or ore-particle breakage in the wet-grinding of solids in mills such as ball, bead, rod or pebble mills, or in autogenous grinding operations.

In the processing of mineral ores and many other solids, the essential step is the comminution of the solids down to the size at which valuable mineral grains are released from the gangue matrix. With the inevitable trend towards working of lower-grade ore deposits, the amounts of minerals liberated tend to decrease and the grinding cost per ton of product increases. This factor alone constitutes a considerable fraction of the overall cost of winning metals and the increase in cost of energy has made grinding costs a very significant factor.

The amount of breakage per unit of time (breakage kinetics) and mass transfer of grinding mineral ores are usually controlled by the addition and removal of water, an excellent medium because of its high polarity, to the mill. When the mass transport of the slurry through the mill decreases, the mill operator takes corrective action by either decreasing the solids feed rate and/or temporarily increasing the amount of water entering the mill. While both actions will prevent the mill from overloading, mill efficiency is reduced because fewer solids are ground per unit of time under such conditions.

Additionally, it is well known that the traditional tumbling mill apparatus used for wet-grinding ores are extremely inefficient in energy utilization, wasting (based on theoretical bond breakage energies) perhaps as much as 90% or more of the energy supplied to the mill. Therefore, even small increases of a few percent in the reduction of size distribution of ore particles and an increase in throughput of ore ground per unit of time would significantly improve the efficiency of grinding and cost of mill operations, especially with respect of energy utilization.

While various methods and chemical agents that act as grinding aids have been employed in efforts to increase grinding efficiencies and economics, these efforts have at best been only partially beneficial and many have even proved to be contradictory in related downstream processing operations. Various chemical agents, e.g., dispersants, surfactants, polysiloxane, organosilicones, glycols, amines, graphite, non-polar liquids and the like have all been utilized and may increase the rate of grinding by preventing particle agglomeration. However, as reported in Perry's Chemical Engineering Handbook, 5th Ed. 1973, at Sec. 8-12, there really is no scientific method of choosing the most effective surfactant. Rather, surfactant lists and kits that can be used for systematic trails are made available.

Chemical agents, such as polyacrylic acid salts, copolymers of acrylic acid and acrylamide, hydrolyzed polyacrylonitrile and the like are known to be useful as dispersants at low molecular weight ranges. Polymers having a molecular weight from a few thousand up to about 50,000, for example, have been utilized as dispersants in the grinding of calcium carbonate to separate impurities therefrom. See U.S. Pat. Nos. 3,534,911 and 3,604,635.

SUMMARY OF THE INVENTION

The present invention provides a process for grinding coal or ores containing metal values which comprises carrying out the grinding operation in the presence of a liquid medium and a grinding aid system comprising (a) an anionic polyelectrolyte comprising polyacrylic acid or polymethacrylic acid and (b) certain inorganic compounds, said system being dispersible in the liquid medium and being employed in an amount effective to synergistically increase grinding efficiency. The use of such grinding aid system results in a substantial increase in the rate of particle breakage and permits higher density (solids) slurries of coal or ore to be ground, thereby achieving a greater volume throughput of solid or ore per unit of time with a corresponding increase in the recovery rates of the desired metal value. The resulting improved efficiency in the overall grinding operations, i.e., in the use of mill capacity and particularly in the consumption of energy per unit of product, is achieved with the present grinding aid system without encountering the decrease in grinding kinetics normally observed when higher density slurries are ground.

It has also been found that the grinding aid system of the present invention usually does not detrimentally effect downstream processing operations which are performed, particularly on mineral ores, after the mineral leaves the grinding mill. For example, the grinding aid system generally does not detrimentally effect processes such as froth flotation processes in which select metal values such as copper, lead, zinc or gold are recovered from the ore with the aid of flotation agents. Neither does the grinding aid system of the present invention seen to have any counterproductive effects in subsequent operations such as, for example, in pelletizing iron ore. Since the polyelectrolyte is adsorbed on the solids, the system does not contribute to downstream pollution problems upon discharge of the aqueous medium such as might be the case with phosphatic materials, for example.

DETAILED DESCRIPTION OF THE INVENTION

The method of the present invention is preferably carried out in the presence of a polar liquid medium in which the grinding aid system is sufficiently dispersible to produce an improvement in grinding efficiency, although the use of a liquid medium which itself is not a solvent for the system may be feasible provided that a solvent or dispersant for the system is also present. Accordingly, the term dispersible means the components are soluble or dispersible in the medium employed to an extent sufficient to provide adsorption thereof on the solid particles and increased grinding efficiency. Water is ordinarily employed and is the preferred medium. The concentration of the solids, e.g., ore or coal, in the liquid medium may vary within wide limits and it is usual to operate with a slurry solids content in the range of from about 40 to about 95, preferably about 50 to about 90, more preferably from 65 to about 88% and most preferably from 70 to about 88, percent by weight of the slurry. Metal ores which may advantageously be treated according to the present invention include iron, copper, gold, silver, lead, zinc, nickel and the like which can be subjected to a wet-grinding treatment. In a preferred embodiment, an ore containing a metal value is ground according to the process of the invention. In another embodiment, coal is preferably ground according to the invention process.

The grinding aid system (hereinafter collectively referred to as the "system") which can be employed in this invention comprises (a) a polyelectrolyte comprising polyacrylic acid or polymethacrylic acid and (b) inorganic compounds selected from the group consisting of the alkali metal salts of carbonates, bicarbonates and silicates and the ammonium salts of carbonates and bicarbonates, the components of said system being sufficiently dispersible in the liquid medium employed to synergistically increase grinding efficiency. The alkali metal salts can be sodium, potassium or the like, preferably sodium or potassium, and most preferably sodium. Sodium silicate and sodium carbonate are preferred inorganic compounds. Exemplary polyelectrolytes include the water soluble or dispersible polymers or copolymers of acrylic or methacrylic acid or the salts thereof. Preferably, the homopolymers are employed. The salt of the acid may be that of an alkali metal, for example, sodium, potassium lithium or the like, or may be an ammonium salt. The alkali metal salts, especially the sodium salts, are preferred. Preferably, the polyelectrolytes are employed in the form of water-soluble salts. Preferred polyelectrolytes are the sodium salts of polyacrylic acid or polymethacrylic acid.

A preferred grinding aid system comprises polymers of (meth)acrylic acid and inorganic compounds. In another embodiment, the system preferably comprises polyacrylic acid and an alkali metal salt of a carbonate or a silicate. In still another preferred embodiment, the system comprises polyacrylic acid and sodium carbonate. In a further preferred embodiment, the system comprises polyacrylic acid and sodium silicate. In another embodiment, a sodium polyacrylate and sodium carbonate system is preferred.

Copolymers of acrylic or methacrylic acid with other ethylenically unsaturated monomers such as, for example, acrylamide, vinylacetate, acrylonitrile, methacrylate, ethylacrylate, 2-methylpropanoic acid and the like are also within the scope of the invention. Such copolymers usually contain about 25 weight percent or more of the acrylic or methacrylic acid moiety. Further, those skilled in the art will recognize that some ethylenically unsaturated polymers, such as, for example, acrylamide, are sometimes characterized by a greater or lesser degree of hydrolysis, i.e., contain some free carboxyl groups. This condition is dependent upon the method of manufacture of the polymer, the presence or absence of other minor ingredients in the starting monomer, e.g., acrylic acid, conditions of storage and the like. The polymer products appear to be equivalent whether the carboxyls result from copolymerization of acrylamide with acrylic acid or from hydrolysis of amide groups subsequent to polymerization or copolymerization and grinding aid products resulting from either method are within the scope of the invention. Other additives, such as triethanolamine, for example, can also be added with the acrylic or methacrylic acid polymer as long as the resulting product contains about 50 weight percent or more of the acrylic or methacrylic acid polymer.

Generally, the anionic group or groups of the system have a pKa of about 8 or less, wherein pKa is a negative logarithm of the acidity constant for the acidic (anionic) group. The average molecular weight (as determined with the Mark Houwink equation) of the polyelectrolytes and salts thereof usually ranges from about two or three thousand up to about fifty thousand. Preferably, polyelectrolytes having an average molecular weight of from about 5000 to about 20,000 and more preferably from about 5000 to about 10,000 are employed. The upper limit on molecular weight is not critical; however, it is known that some very high molecular weight polymers are difficult to get into solution but that colloidal dispersions thereof can be formed in the medium. Polyelectrolytes which are otherwise insoluble or nondispersible in the medium are not included within the scope of the invention.

Water-soluble polymers of the type exemplified above are known and can be prepared by a variety of methods. Examples of suitable water-soluble polymers include, for example, available products such as, for example, DISPEX N-40® (manufactured by Allied Colloide Manufacturing Company Ltd.), DAXAD® (available for W. R. Grace Co.), TAMOL 850® (Rohm and Haas Co.) and GOODRITE K732® (Goodrich Tire and Rubber Co.) and the like.

Polyacrylic or polymethacrylic homopolymers which are especially suitable for use in this invention are readily prepared from the monomer by the action of heat, light, and/or catalysts. Catalysts which are particularly effective for this polymerization include peroxides. The properties and nature of the polymer can be varied over a considerable range by the proper choice of catalysts and/or reaction conditions.

Polyelectrolytes which are preferred in the present invention are most advantageously made by polymerizing the monomer, for example, acrylic acid, in aqueous solution at about 50°–170° C. in the presence of a redox polymerization catalyst system by dispersing acrylic acid and a peroxy catalyst separately and continuously into the aqueous medium at rates such that an effective and substantially constant concentration of the catalyst system is maintained in contact with the acrylic acid throughout the polymerization. A reducing agent can be combined with the acrylic acid and the two added as a single aqueous solution, but preferably, the reducing agent is added separately and continuously as a third stream.

The peroxy catalyst component can be any peroxide useful as a polymerization catalyst. Suitable peroxides, which preferably are water soluble, include hydrogen peroxide, tert-butyl hydroperoxide and salts of per acids such as sodium persulfate, potassium percarbonate, ammonium peracetate, sodium perbenzoate, sodium perborate, and the like.

The concentration of peroxygen-containing catalyst can vary widely within limits of about 0.1–10% based on the entire polymerization mixture and referring to active catalyst present in the system at any one time during the process. Preferably, the amount of aqueous medium and the rates of addition of catalyst and acrylic acid are adjusted so that a relatively high peroxy catalyst concentration is maintained. Total peroxy catalyst used based on the acrylic acid is preferably about 0.5–5 mole percent. The reducing agent is employed in at least a molar equivalent amount based on the peroxy component and preferably is used in a quantity of about 20–100 percent excess. Both components of the redox catalyst system are preferably added as aqueous solutions of relatively high concentration.

The aqueous polymerization medium is preferably water but it may include up to about 30% by volume of a water-miscible organic solvent such as acetone, a lower alkanol, or dimethyl sulfoxide. Efficient stirring of the polymerization mixture or agitation by other effective means is required so that the streams of peroxy catalyst, reducing agent, and acrylic acid are quickly and thoroughly dispersed and intimately mixed in the polymerization medium. Superatmospheric pressure may be advantageous.

Other modes of polymerization may also be employed. These are well known in the art and the particular process employed is not critical to this invention.

The amount of grinding aid system employed to increase grinding efficiency, e.g., the rate and type of ore-particle breakage, e.g., ore classification, which can respectively be described as the "selection" and "distribution" functions of grinding, will vary depending upon certain factors including properties which are unique to coal and each ore. For example, the "selection function", which describes the probability that a particle of any particular size will be broken in a given unit or time, will be affected by any factors which change the probability of particle breakage. Factors such as slurry volume, number and size of grinding media (e.g., balls, rods, etc.), raw ore particle size, mill rpm and the like, as well as ore properties, all affect the probability of successful particle breakage. The properties unique to coal or each ore also affect the "distribution function", that is, the number and size distribution of fragments into which a particle will subdivide when it is broke. Measurement of the number and size distribution of fragments after grinding will allow the calculation of the effect of the system on the selection and distribution functions which will indicate the effectiveness of the grinding aid system added.

Grinding efficiency can, for example, be determined from the amount of particulate solid of particle size less than 325 mesh (44 micrometers) U.S. Standard, that can be formed from a given liquid slurry of constant volume of liquid and ore solids using the same energy input. Normally, as the weight percent of ore solids in this slurry is increased, the grinding efficiency of the grinding medium is reduced. Thus, it is critical in the practice of this invention that the amount of grinding aid system employed be sufficient to reverse the trend towards a lower grinding efficiency as weight percent concentration of ore solids in the slurry is increased.

The liquid slurry preferably contains grinding media wherein the media are as employed in large ore grinding mills such as ball, bead, rod or pebble mills. The media are generally of a size large enough where they do not contribute to an increase in the inherent viscosity of the slurry. Thus, the type of mills under consideration here are distinct from those mills in which paint pigments are ground to an extreme fineness with a extremely small granular grinding medium.

Generally, any combination of polyelectrolyte and inorganic compound which improves grinding efficiencies as compared with the use of the polyelectrolyte or inorganic compound alone are within the scope of the present invention. Preferred ratios of the polyelectrolyte to inorganic compound generally range from about 1:1 to about 1:10, with ratios of from about 1:1 to about 1:6 by weight being preferred. A ratio from about 1:1 to about 1:4 constitutes a further preferred embodiment. The ratio employed will, as those skilled in the art will recognize, vary depending upon the type of ore and grinding operation employed, the viscosity required for a particular operation, the grinding time and the like. Generally, it has been found that concentration ranges of from about 0.002 to about 0.05 weight percent (based on slurry solids) of the polyelectrolyte used in combination with from about 0.005 to about 0.2 weight percent inorganic compound produce synergistic results in increasing grinding efficiencies when the concentrations are used in the ratios stated above. In a preferred embodiment, concentrations of from about 0.002 to about 0.01 weight percent polyelectrolyte and from about 0.005 to about 0.05 weight percent inorganic compound are employed. In another embodiment, polyelectrolyte concentrations of from about 0.005 to about 0.01 weight percent (e.g., from about 0.05 to about 0.1 mg/gm) and inorganic compound concentrations of from about 0.01 to about 0.05 weight percent are preferred.

Those skilled in the art will also recognize that it is difficult to establish any one preferred concentration range for the polyelectrolytes and inorganic salts as this will depend upon the viscosity required for a particular operation as well as the particular ore or coal being ground. The optimum amount of aid from an economic and/or utility viewpoint will, of course, depend upon, inter alia, the particular ore to be ground and other various factors as described herein. Those skilled in the art can readily ascertain the desired synergistic concentrations according to the procedures set forth herein or others known in the art.

In batch operations, grinding periods of from 5 to 10 minutes or longer are usually sufficient to measure an increase in the fineness of grind when using a system as taught herein. In open cycle continuous grinding operations, the increased throughput and/or increased fineness of grind at constant throughput is readily ascertained. In continuous closed cycle grinding operations, however, much of the ore being ground is continuously recycled through the grinder until the desired degree of fineness is obtained and the actual grinding time per unit ore can only be calculated on an average residence basis. This will vary with the type of ore used and the amount of grinding required to meet size distribution requirements. With iron ore, for instance, grinding must be continued until the particle size is less than 325 mesh (U.S. Standard), sometimes less than 500 mesh. Again, those skilled in the art of grinding will be able to ascertain the grinding time needed.

Increases in grinding kinetics are determined by measuring the change in the weight and size distribution of fragments obtained per unit of time. An increase in the amount of grinding or fineness of grind as determined by measurement of the particle sizes resulting per unit grinding time means that more grinding takes place. Illustrating the increased grinding rates achieved in another manner, it is readily apparent that if a grinding viscosity of, for example, 50,000 cps is desired and the untreated ore slurry is at 68% solids, one can grind a higher solids density slurry of, for example, 72% solids, by use of a grinding aid system without any change in grinding conditions. Increases in the grinding rate of only a percent or two, while numerically small, are highly desirable as they represent truly significant savings in energy costs. According to the methods of the present invention, experimental data indicates that increases of from about 1 to about 10 percent or more of the grinding rate can be achieved with the use of grinding aid system taught herein.

In determining the usefulness of a particular grinding aid system, various chemical combinations can be first screened to determine the ability of a particular combination to decrease the viscosity of a finely ground ore. Those systems generally found to decrease the low shear viscosity of the finely ground ore (ground to an average particle size of 325 mesh and having a solids concentration between about 50 to 95% by weight) by about 20–25 percent or more are usually subsequently found to be very effective as grinding aids. In one means of determination, improved grinding efficiencies may be obtained if a system effects a minimum 10% reduction in low shear viscosity (viscosity was determined with a Brookfield viscometer Model RVT using a #D bar at 25° C. and 5 rpm and mounted on a helipath stand) of such a ground ore or coal slurry when the system is added to the slurry in amount sufficient to provide a concentration of at least 0.02 weight percent based on total solids. Generally, the greater the decrease in slurry viscosity, the greater the increase in grinding. However, viscosity data alone is not sufficient by itself to predict that any increase in grinding efficiency will necessarily result or to indicate the degree of any increase in grinding efficiency which might be obtained. This will have to be determined by actual grinding trials. In carrying out actual grinding tests, an ore sample is first ground in a typical ball mill using plain water as a liquid phase. After each grinding run of a predetermined time, the size distribution of the product is determined by wet screening. Enough runs are made with different grinding periods and slurry concentrations and individual components so that the change in the weight and size of fragments can be determined. The runs are then repeated incorporating a grinding aid system into the slurry and making the same determinations. The changes in the size and weight of fragments as compared with the controls indicate the effectiveness of the grinding aid.

The following example is presented to illustrate the invention, but is not to be construed as limiting it in any manner whatsoever. The ore slurry percent is based on the weight of solids present in the slurry being treated and the milligrams per gram is based upon the number of milligrams of actual grinding aid system per gram of ore.

EXAMPLE 1

A ball mill, 19.5 centimeters (cm) internal diameter and about 20 cm in length, operated at about 60 rpm and containing about 110 one-inch steel balls, was utilized for grinding studies on various ores to determine the effectiveness of using grinding aids of the present invention. In such operations, the ore was crushed and portions of the crushed ore passing through a 10 U.S. mesh screen were mixed with appropriate amounts of water in the mill to form slurries of desired concentrations. Once the desired slurry concentration was formed, the mill was sealed and operated for various grinding periods, after which the resultant ground ore slurry was removed and the amount of particles passing through a 325 U.S. mesh screen determined. The trials were then repeated, using the same concentrations and grinding times, with the addition of various amounts of a grinding aid system to the aqueous slurry prior to grinding. The results of such operations, indicating the effectiveness of the grinding aid system in improving grinding kinetics (relative % increases), are set forth below:

| Run No. | Additive | mg/gm | Wt. % Passing 325 Mesh | % Increase |
|---|---|---|---|---|
| 1. | None | — | 38.4 | — |
| 2. | A | 0.2 | 40.2 | 4.6 |
| 3. | B | 0.05 | 40.5 | 5.4 |
| 4. | A/B | 0.2/0.05 | 41.9 | 9.1 |
| 5. | None | — | 38.4 | — |
| 6. | C | 0.2 | 40.3 | 4.9 |
| 7. | B | 0.05 | 40.5 | 5.5 |
| 8. | C/B | 0.2/0.05 | 41.5 | 8.1 |

A = $Na_2SiO_3 \cdot 9H_2O$
B = Sodium polyacrylate
C = $Na_2CO_3$

As compared with the control (Run No. 1), it is seen that the grinding aid system comprising sodium silicate and sodium polyacrylate increased the actual amount of ground ore passing through the 325 mesh screen by 3.5 wt. % which is an increase of 9.1%. Such a significant increase is clearly surprising and unexpected, as compared with the increases obtained with the silicate (Run No. 2–4.6% over control) and polyacrylate (Run No. 3–5.4% over control) components used alone.

The grinding aid system comprising sodium carbonate and sodium polyacrylate (Run No. 8) gave similarly unexpected increases in the amount ground over the control (Run No. 5), a 3.1 wt. % increase which represents a total increase in amount of 8.1%. The increase in amounts ground by the components alone were 4.9% (Run No. 6) and 5.5% (Run No. 7), respectively.

Measurements at other particle sizes and ranges also indicate similar significant increases. Other grinding aid systems of the invention and other ratios are similarly found to significantly enhance the grinding kinetics as compared with the use of the components thereof alone.

As will be apparent from the foregoing specification and examples, the best mode for carrying out the invention in reversing any trend towards lower grinding efficiency as the wt. % concentration of ore is increased is as described in the preferred embodiments concerning the grinding aids, the amounts thereof, the grinding trials and result (grinding kinetic increases) determination procedures. In efforts to optimize the use of the grinding aid system of the present invention, preliminary trials indicate that the effectiveness of a grinding aid system using sodium polyacrylate as the polyelectrolyte is enhanced if the pH of the slurry being ground is adjusted to higher levels, e.g., from about 8 to about 10 or more. Thus, in the grinding of certain ores where use of high slurry pH levels is beneficial and compatible with all aspects of the ore treating circuit concerned (i.e., flotation, etc.), such as the grinding of molybdenum, uranium, copper, etc., the best mode for using a sodium polyacrylate $Na_2CO_3.H_2O$ system appears to be in conjunction with the use of additional base, such as NaOH. Accordingly, where use of higher pH levels in a grinding circuit can be employed, it is believed the best mode presently known for using a grinding aid system of the present invention is in conjunction with a base mixture of NaOH and $Na_2CO_3.H_2O$. Where sodium polyacrylate is the polyelectrolyte and a taconite ore is being ground, the best mode appears to be the use of 0.2 mg of the polymer per gm of ore with from about 0.3 to about 0.4 mg of combined $Na_2CO_3.H_2O$-NaOH base mixture (usually equal amounts of each) per gram of ore.

While this invention has been described with reference to certain specific embodiments, it is, of course, to be understood that the invention is not so limited except insofar as appear in the accompanying claims.

We claim:

1. A process for grinding ores containing metal values or coal, which comprises carrying out said grinding in the presence of a liquid medium and a grinding aid system comprising (a) a polyelectrolyte comprising acrylic or methacrylic acid polymers or copolymers of the same together or with other ethylenically unsaturated monomers, and (b) an inorganic compound selected from the group consisting of alkali metal salts of carbonates and bicarbonates, said grinding aid system being dispersible in said medium and being employed in an amount effective to synergistically increase grinding efficiency.

2. The process of claim 1 wherein the polyelectrolyte is a homopolymer of acrylic acid.

3. The process of claim 1 wherein the polyelectrolyte is a homopolymer of methacrylic acid.

4. The process of claim 1 wherein the polyelectrolyte comprises a copolymer of acrylic acid with an ethylenically unsaturated monomer.

5. The process of claim 1 wherein the polyelectrolyte comprises a copolymer of methacrylic acid with an ethylenically unsaturated monomer.

6. The process of claim 1 wherein ores containing metal values are ground.

7. The process of claim 1 wherein coal is ground.

8. The process of claim 6 wherein the grinding aid system comprises (a) a homopolymer of acrylic acid and (b) an alkali metal carbonate or bicarbonate.

9. The process of claim 6 wherein the grinding aid system is a homopolymer of acrylic acid and an alkali metal silicate.

10. A process for grinding ores containing metal values or coal, which comprises carrying out said grinding in the presence of a liquid medium and a grinding aid system comprising (a) salts of a polyelectrolyte comprising acrylic or methacrylic acid polymers or copolymers of the same together or with other ethylenically unsaturated monomers, and (b) an inorganic compound selected from the group consisting of alkali metal salts of carbonates, bicarbonates and silicates or ammonium salts of carbonates and bicarbonates, said grinding aid system being dispersible in said medium and being employed in an amount effective to synergistically increase grinding efficiency.

11. The process of claim 10 wherein the polyelectrolyte is a salt of an acrylic acid homopolymer.

12. The process of claim 10 wherein the polyelectrolyte is a salt of a methacrylic acid homopolymer.

13. The process of claim 2 wherein the salt is an alkali metal or ammonium salt.

14. The process of claim 12 wherein the salt is an alkali metal or ammonium salt.

15. The process of claim 10 wherein the polyelectrolyte is sodium acrylate.

16. The process of claim 10 wherein the polyelectrolyte is sodium methacrylate.

17. The process of claim 10 wherein the polyelectrolyte comprises a copolymer of acrylic acid with an ethylenically unsaturated monomer.

18. The process of claim 10 wherein the polyelectrolyte comprises a copolymer of methacrylic acid with an ethylenically unsaturated monomer.

19. The process of claim 15 wherein the inorganic compound is sodium carbonate.

20. The process of claim 16 wherein the inorganic compound is sodium carbonate.

21. The process of claim 10 wherein coal is ground.

22. The process of claim 10 wherein ores containing metal values are ground.

* * * * *